US007754991B2

(12) United States Patent
Bessede et al.

(10) Patent No.: US 7,754,991 B2
(45) Date of Patent: Jul. 13, 2010

(54) MEDIUM-VOLTAGE OR HIGH VOLTAGE ELECTRICAL SWITCHGEAR

(75) Inventors: Jean-Luc Bessede, Chateauvilain (FR); Oana Aitken, Saint Egreve (FR)

(73) Assignee: Areva T&D SA, Paris la Defense Cedex (FR)

( * ) Notice: Subject to any disclaimer, the term of this patent is extended or adjusted under 35 U.S.C. 154(b) by 879 days.

(21) Appl. No.: 11/587,286

(22) PCT Filed: Apr. 20, 2005

(86) PCT No.: PCT/FR2005/050263

§ 371 (c)(1),
(2), (4) Date: Oct. 18, 2006

(87) PCT Pub. No.: WO2005/106910

PCT Pub. Date: Nov. 10, 2005

(65) Prior Publication Data

US 2009/0294406 A1 Dec. 3, 2009

(30) Foreign Application Priority Data

Apr. 21, 2004 (FR) ..... 04 50754

(51) Int. Cl.
*H01H 33/76* (2006.01)

(52) U.S. Cl. ..... 218/85; 218/43; 218/158

(58) Field of Classification Search ..... 218/7, 218/13–15, 34, 43, 46, 51, 76, 81, 85, 149–158; 335/201, 202

See application file for complete search history.

(56) References Cited

U.S. PATENT DOCUMENTS

| | | | | |
|---|---|---|---|---|
| 4,011,426 | A * | 3/1977 | Lange | 218/150 |
| 4,684,773 | A | 8/1987 | Niemeyer | 200/148 |
| 5,925,863 | A * | 7/1999 | Zehnder et al. | 218/53 |
| 6,437,273 | B2 | 8/2002 | Stechbarth et al. | 218/3 |

(Continued)

FOREIGN PATENT DOCUMENTS

| | | |
|---|---|---|
| DE | 708319 C | 7/1941 |

(Continued)

OTHER PUBLICATIONS

Search Report, 04 50754 1 pg, (Nov. 22, 2004).

*Primary Examiner*—Renee Luebke
*Assistant Examiner*—Marina Fishman
(74) *Attorney, Agent, or Firm*—Nixon Peabody LLP

(57) ABSTRACT

This electrical switchgear has an interrupting chamber enclosing an interrupting gas (G) substantially devoid of $SF_6$ and of $CF_4$, and a first arcing contact (10) and a second arcing contact (18), the two arcing contacts moving causes an electric arc (26) to strike, while at least one irradiation wall (22) is provided that is suitable for being reached by the electric arc. At least two component materials that are part of at least one element selected from the interrupting gas, the first and second arcing contacts, and the or each irradiation wall, are suitable for decomposing under the effect of the electric arc, so as to form decomposed species ($e_1$, $e_2$) suitable for combining in the interrupting chamber, in order to form at least one new gaseous species ($G_1$), before the electric arc is extinguished, the dielectric properties of said at least one new gaseous species being superior to the dielectric properties of said interrupting gas (G).

80 Claims, 2 Drawing Sheets

U.S. PATENT DOCUMENTS

| | | | | |
|---|---|---|---|---|
| 6,593,538 | B2 | 7/2003 | Perret et al. | 218/3 |
| 6,744,000 | B1 * | 6/2004 | Bergmann et al. | 218/64 |

FOREIGN PATENT DOCUMENTS

| | | | |
|---|---|---|---|
| DE | 1111267 | | 7/1961 |
| EP | 0737993 | A1 | 10/1996 |
| EP | 0840340 | A2 | 5/1998 |
| FR | 1537616 | A | 8/1968 |
| GB | 1100564 | A | 1/1968 |

* cited by examiner

MEDIUM-VOLTAGE OR HIGH VOLTAGE ELECTRICAL SWITCHGEAR

CROSS-REFERENCE TO RELATED APPLICATION

This application claims priority based on International Patent Application No. PCT/FR2005/050263, filed on Apr. 20, 2005, entitled "Electrical Medium- Or High-Voltage Cut-off Device" by Jean-Luc Bessede and Oana Aitken, which claims priority of French Application No. 0 4 50754, filed on Apr. 21, 2004.

TECHNICAL FIELD

The present invention relates to medium-voltage or high-voltage electrical switchgear.

In the sense of the invention, such electrical switchgear is, for example, a circuit-breaker, a disconnector, a contactor, or a load switch. The term "medium-voltage or high-voltage" refers to voltage higher than about 1000 volts.

STATE OF THE PRIOR ART

In known manner, such switchgear has a set of contacts which is provided with a fixed contact member and with a moving contact member, each of which is equipped with a respective contact element. The moving element can thus be moved relative to the fixed element between a contact position and an interrupting separated position.

When the moving member moves between the contact position and the separated position, an electric arc strikes between the two contact elements, which arc disappears once said arc has been interrupted.

In addition, the moving contact is provided with an insulating nozzle which defines an annular channel via which, while the moving member is moving, an insulating gas, also referred to as an "interrupting gas", is directed towards the zone in which the electric arc strikes.

It should be noted that, in the sense of the present invention, the gas is suitable for interrupting the electrical switchgear repeatedly, i.e. an arc can be interrupted a plurality of times.

In the state of the art, it is known that sulfur hexafluoride ($SF_6$) or indeed carbon tetrafluoride ($CF_4$) can be used as interrupting insulating gas. Those two gases have good insulating properties, which makes it possible to obtain electrical switchgear in which parts can be live while also being close together. In addition, they suffer almost no loss in their properties when the arc strikes, so that they offer substantially no sustenance to said arc, and are then capable of recovering said properties quickly after interrupting the arc.

Unfortunately, the two above-mentioned gases suffer from an environmental drawback since they are known to generate a greenhouse effect.

In order to remedy that problem, it has been proposed to use other types of insulating gas. Thus, EP-A-0 737 993 and EP-A-1 271 590 mention the possibility of using high-pressure nitrogen.

Although satisfactory in environmental terms, that alternative gas does not offer properties comparable to the properties of $CF_4$ or of $SF_6$.

Thus, the dielectric properties of nitrogen are firstly not as good as the properties of $SF_6$ or of $CF_4$. Therefore, it is necessary to impart higher pressure to the gas, or else to dispose the various parts of the switchgear further apart.

In addition, nitrogen is less satisfactory than $CF_4$ or $SF_6$ in terms of interrupting quality. When an arc strikes, nitrogen sustains it for a longer period than $CF_4$ or $SF_6$.

SUMMARY OF THE INVENTION

An object of the invention is to propose electrical switchgear which, while using an interrupting gas substantially devoid of $CF_4$ and of $SF_6$, offers performance, in particular in interruption terms and in dielectric terms, that is close to the performance offered by prior art switchgear that uses these two gas.

To this end, the invention provides a medium-voltage or high-voltage electrical switchgear, in particular a circuit-breaker or a disconnector, having an interrupting chamber enclosing an interrupting gas substantially devoid of sulfur hexafluoride ($SF_6$) and of carbon tetrafluoride ($CF_4$), the interrupting chamber containing a first contact member and a second contact member, which contact members are provided respectively with a first arcing contact and with a second arcing contact, the two arcing contacts being suitable, when in service, for taking up a first position in which they are in contact with each other, and a second position in which they are separated from each other, the two arcing contacts moving between the first position and the second position causing an electric arc to strike, while at least one irradiation wall suitable for being reached by the electric arc is provided in the vicinity of said arcing contacts, at least two component materials that are part of at least one element selected from the interrupting gas, the first arcing contact and the second arcing contact, and the or each irradiation wall, being suitable for decomposing under the effect of the electric arc, so as to form decomposed species suitable for combining in the interrupting chamber, in order to form at least one new gaseous species, at least while the electric arc is being extinguished, the dielectric properties of said new gaseous species being superior to the dielectric properties of the interrupting gas, at least one element selected from the interrupting gas, the first arcing contact and the second arcing contact, and the or each irradiation wall includes an oxide suitable for decomposing under the effect of the electric arc, so as to form at least one auxiliary decomposed species suitable for combining with the decomposed species, so as to prevent pure carbon from forming, said oxide being associated with at least one solid fluoride, in the same solid element, said electrical switchgear being characterized in that the solid fluoride is a fluorine-containing polymer, such as polytetrafluoroethylene (PTFE), the proportion by weight of the fluorine-containing polymer being in the range 50% to 80%, and preferably in the range 60% to 70%, of the total formed by the fluorine-containing polymer and by said oxide.

In a variant, said oxide is associated, with a fluorine-containing polymer, such as polytetrafluoroethylene (PTFE), and with another solid fluoride.

The invention also provides a medium-voltage or high-voltage electrical switchgear, in particular a circuit-breaker or a disconnector, having an interrupting chamber enclosing an interrupting gas substantially devoid of sulfur hexafluoride ($SF_6$) and of carbon tetrafluoride ($CF_4$), the interrupting chamber containing a first contact member and a second contact member, which contact members are provided respectively with a first arcing contact and with a second arcing contact, the two arcing contacts being suitable, when in service, for taking up a first position in which they are in contact with each other, and a second position in which they are separated from each other, the two arcing contacts moving between the first position and the second position causing an electric arc to strike, while at least one irradiation wall suitable for being reached by the electric arc is provided in the vicinity of said arcing contacts, at least two component materials that are part of at least one element selected from the interrupting gas, the first arcing contact and the second arcing contact, and the or each irradiation wall, being suitable for decomposing under the effect of the electric arc, so as to form decomposed species suitable for combining in the interrupting chamber, in order to form at least one new gaseous species, at least while the electric arc is being extinguished, the dielectric properties of said new gaseous species being superior to the dielectric properties of the interrupting gas, at least one element selected from the interrupting gas, the first arcing contact and the second arcing contact, and the or each irradiation wall includes an oxide suitable for decomposing under the effect of the electric arc, so as to form at least one auxiliary decomposed species suitable for combining with the decomposed species, so as to prevent pure carbon from forming, said oxide being associated with at least one solid fluoride, in the same solid element, said electrical switchgear being characterized in that said oxide is also associated, in the same solid element, with a fluorine-containing polymer, such as polytetrafluoroethylene (PTFE), and with a solid sulfide and in that the ratio by weight of the oxide to the solid sulfide lies in the range 2 to 3, while said oxide and said solid sulfide represent, by volume, 25% to 40%, and preferably 30% to 35%, of the total formed by the fluorine-containing polymer, by the solid sulfide and by the oxide.

The invention also provides a medium-voltage or high-voltage electrical switchgear, in particular a circuit-breaker or a disconnector, having an interrupting chamber enclosing an interrupting gas substantially devoid of sulfur hexafluoride ($SF_6$) and of carbon tetrafluoride ($CF_4$), the interrupting chamber containing a first contact member and a second contact member, which contact members are provided respectively with a first arcing contact and with a second arcing contact, the two arcing contacts being suitable, when in service, for taking up a first position in which they are in contact with each other, and a second position in which they are separated from each other, the two arcing contacts moving between the first position and the second position causing an electric arc to strike, while at least one irradiation wall suitable for being reached by the electric arc is provided in the vicinity of said arcing contacts, at least two component materials that are part of at least one element selected from the interrupting gas, the first arcing contact and the second arcing contact, and the or each irradiation wall, being suitable for decomposing under the effect of the electric arc, so as to form decomposed species suitable for combining in the interrupting chamber, in order to form at least one new gaseous species, at least while the electric arc is being extinguished, the dielectric properties of said new gaseous species being superior to the dielectric properties of the interrupting gas, at least one element selected from the interrupting gas, the first arcing contact and the second arcing contact, and the or each irradiation wall includes an oxide suitable for decomposing under the effect of the electric arc, so as to form at least one auxiliary decomposed species suitable for combining with the decomposed species, so as to prevent pure carbon from forming, said oxide being associated with at least one solid fluoride, in the same solid element, said electrical switchgear being characterized in that said oxide is also associated, in the same solid element, with a fluorine-containing polymer, such as polytetrafluoroethylene (PTFE), and with a solid nitride. By way of non-limiting example, mentioned is made of boron nitride (BN), silicon nitride ($Si_3N_4$) or indeed aluminum nitride (AlN).

Advantageously, the ratio by weight of the oxide to the solid nitride lies in the range 0.4 to 3, while said oxide and said solid nitride represent, by volume, 25% to 40%, and preferably 30% to 35%, of the total formed by the fluorine-containing polymer, by the solid nitride, and by the oxide.

By way of non-limiting example, in order to illustrate the various interrupting gases suitable for use in the switchgear of the invention, mention is made, in particular, of nitrogen, nitrogen oxide, argon, carbon dioxide, and mixtures thereof.

In the invention, at least two component materials are used for forming decomposed species which, in turn, are suitable for recombining to form at least one new gaseous species. These component materials, being two or more, are part of at least one element selected from the interrupting gas, the arcing contacts, and the irradiation wall(s). In other words, the component materials can be part of a single one of these elements or else be part of at least two of them.

When an arc strikes, the above-mentioned component materials decompose so as to form a plasma, in which decomposed species are present in the form of optionally ionized mono-atomic or poly-atomic chemical species. These species then recombine extremely quickly, through reactions in which stability is maximized and energy requirement is minimized. This thus leads to at least one new gaseous species being formed, the dielectric properties of which are significantly superior to the dielectric properties of the initial interrupting gas which is, in particular, nitrogen.

Since the above-mentioned reactions of decomposition and then recomposition are substantially instantaneous, the new species form(s) before the electric arc is interrupted. In this way, said arc finds itself in a gaseous medium whose dielectric properties are improved compared with the dielectric properties of the interrupting gas, and this is advantageous for good overall operation of the electrical switchgear. Under these conditions, the invention guarantees interrupting properties that are substantially in the vicinity of the interrupting properties offered by prior art solutions using $CF_4$ or $SF_6$.

Similarly, when the current decreases and reaches zero, and when the electric arc is extinguished, the dielectric properties of the gaseous medium between the electrodes are improved compared with the dielectric properties of the interrupting gas. Also under these conditions, the invention guarantees post-interruption dielectric strength properties that are quite close to the properties offered by prior art solutions using $CF_4$ or $SF_6$.

In addition, the invention is significantly more advantageous than such prior art solutions from an environmental point of view.

Actually, by means of the invention, it is not necessary, for the purposes of initially bringing the electrical switchgear into service, to fill it with a gas that has a strong greenhouse effect. In addition any new gaseous species having a recognized greenhouse effect and that are generated when an electric arc strikes through the above-mentioned decomposition and recomposition reactions are present in very small quantities. It should be noted that such gaseous species having a greenhouse effect and that are formed in situ appear, in time, only when the arc strikes and, in space, only in the vicinity of said arc.

In order to optimize implementation of the invention, and thus in order to obtain a substantial quantity of gaseous species having high dielectric properties, the person skilled in the art can act on the following parameters:

- stoichiometric quantities of the various component materials, in particular when they are part of the same element;
- percentage by volume of filler, when a fluorine-containing polymer is used, advantageously less than 40%, guaranteeing the strength of said polymer;
- purity and grain-size distribution of any fillers;
- size of the working area irradiated by the arc, in particular when the element in question is of the solid type;
- distance between the plasma and the material(s) suitable for decomposing.

It should be understood that, in the description and the claims of the present application, the various fillers are considered to be pure, i.e. having less than 5% of elements other than the chemical species of the filler in question. In addition, the fillers have a grain size less than 100 micrometers, i.e. they are of the micronic or nanometric type.

It should also be emphasized that the invention clearly differs from prior art in which the interrupting chamber is provided with a nozzle, for channeling the interrupting gas, that is made of polytetrafluoroethylene (PTFE), or indeed Teflon. Indeed, in such a solution, as illustrated for example by U.S. Pat. No. 6,437,273, the proportions of the various component materials suitable for decomposing when the electric arc strikes are not adapted to forming gaseous species, such as $SF_6$ or $CF_4$, in quantities making it possible to increase significantly the dielectric properties of the interrupting gas.

Such an oxide could be, for example, silicon oxide ($SiO_2$), titanium oxide ($TiO_2$), aluminum oxide ($Al_2O_3$), or indeed phosphorus oxide ($P_2O_5$). This oxide decomposes under the effect of the electric arc, so as to form, in particular, free oxygen atoms or ions. Said atoms or ions are then capable of reacting with the carbon ions that are decomposed in the plasma. This leads to carbon oxide(s) being formed, in particular carbon monoxide or carbon dioxide, which makes it possible to prevent pure carbon from forming. This measure is particularly advantageous because it makes it possible to avoid a drop in performance of the switchgear due to such pure carbon being deposited on certain members of the switchgear, such as the channeling nozzle.

Advantageously, the interrupting gas includes at least one additional gas, which contains at least one gaseous component suitable for decomposing, the or each additional gas being a fluorine-containing gas, in particular xenon fluoride ($XeF_4$) and/or a carbon-containing gas, in particular carbon dioxide ($CO_2$) and/or a sulfur-containing gas, in particular sulfur dioxide ($SO_2$).

Mention can also be made of the possibility of including in the interrupting gas sulfur hexafluoride ($SF_6$) and/or carbon tetrafluoride ($CF_4$). However, it is recalled that, in the sense of the invention, the interrupting gas is substantially devoid of these two additional gases so that they are present in very small quantities, at the most equal to a few percent. It is also possible to include in the interrupting gas tungsten hexafluoride ($WF_6$), nitrogen fluoride ($NF_3$), or indeed uranium hexafluoride ($UF_6$).

In a first alternative of the invention, the or each gaseous component suitable for decomposing is suitable for combining with at least one component material that is suitable for decomposing, and that is part of at least one solid element.

In another alternative of the invention, a plurality of gaseous component materials are provided that are suitable for decomposing under the effect of the electric arc. Under these conditions, the invention involves successive decomposition and recombination reactions, which take place entirely in gaseous form.

Advantageously, the additional gas is a fluorine-containing gas preferably selected from $XeF_4$, $XeF_2$, $SiF_4$ or $NF_3$. Preferably, the fluorine-containing gas lies in the range 1 to 20% by volume.

According to an advantageous characteristic of the invention, the or each new gaseous species contains fluorine and sulfur and/or carbon. In particular, the new gaseous species is/are carbon tetrafluoride ($CF_4$) and/or sulfur hexafluoride ($SF_6$).

According to another advantageous characteristic of the invention, the or each new gaseous species contains oxygen and carbon and/or nitrogen. In particular, the new gaseous species is/are carbon dioxide ($CO_2$) and/or nitrous oxide ($N_2O$).

In a variant of the invention, at least one component material suitable for decomposing under the effect of the electric arc is part of at least one solid element, the or each component material being present at least on the surface of said solid element which is irradiated by the electric arc, when in service. Under these conditions, the solid element in question is formed by at least one of the arcing contacts and/or by at least one irradiation wall.

In advantageous manner, one solid element is constituted by an insulating nozzle for channeling the interrupting gas. Thus, in addition to its conventional channeling function, the nozzle performs an additional function of delivering at least one component material suitable for decomposing.

In another variant, at least one component material that is suitable for decomposing is part of said insulating nozzle, while at least one other component material that is suitable for decomposing is part of another irradiation wall, distinct from said nozzle. Under such conditions, said other wall is specifically dedicated to the function of delivering at least one component material suitable for decomposing under the effect of the electric arc.

In a possibility of the invention, at least one component material that is part of at least one solid element and that is different from the element comprising the oxide associated to the at least one solid fluoride, is a solid fluoride. By way of non-limiting example, mention is made in particular of fluorine-containing polymers such as polytetrafluoroethylene or PTFE $(CF_2)_n$, also referred to as Teflon, and calcium fluoride $CaF_2$, aluminum fluoride $AlF_3$, copper fluoride $Cu_2F_2$, or indeed titanium fluoride $TiF_4$.

In another variant of the invention, it is possible to associate first and second different types of fluorides, in particular when they are part of the same solid element. Advantageously, a first component material that is suitable for decomposing is a fluorine-containing polymer, such as polytetrafluoroethylene (PTFE), while another component suitable for decomposing is another fluoride, of a different type. Said other fluoride is, for example, $CaF_2$, $AlF_3$, $Cu_2F_2$, or $TiF_4$.

When the fluorine-containing polymer and the other type of fluoride are part of the same solid element, the proportion by weight of the PTFE lies advantageously in the range 60% to 80%, and preferably in the range 65% to 75%, of the total constituted by the fluorine-containing polymer and by the other solid fluoride.

In another possibility of the invention, at least one component material that is part of at least one solid element is a solid sulfide. By way of non-limiting example, mention is made of antimony sulfide $Sb_2S_3$ or $Sb_2S_5$, or molybdenum sulfide $MoS_2$.

In another variant of the invention, at least one component material that is suitable for decomposing is a solid fluoride, while at least one other component material that is suitable for decomposing is a solid sulfide.

In a first alternative, a first component material is a fluorine-containing polymer, such as polytetrafluoroethylene (PTFE), while another component is a solid sulfide. When the fluorine-containing polymer and the solid sulfide are part of the same solid element, the proportion by weight of the fluorine-containing polymer lies advantageously in the range 50% to 80%, and preferably in the range 60% to 70%, of the total constituted by the fluorine-containing polymer and by the solid sulfide.

In another alternative, a first component material is a fluorine-containing polymer, such as polytetrafluoroethylene (PTFE), a second component material is another type of solid fluoride, while a third component material is a solid sulfide. When the fluorine-containing polymer, the other fluoride and the sulfide are part of the same solid element, the ratio by weight of the other fluoride to the sulfide lies in the range 3 to 4, while said other fluoride and the sulfide represent, by volume, 25% to 40%, and preferably 30% to 35%, of the total formed by the fluorine-containing polymer, by the other fluoride, and by the sulfide.

In another variant of the invention, at least one component material that is suitable for decomposing under the effect of the electric arc is a gaseous component.

BRIEF DESCRIPTION OF THE FIGURES

The invention is described below with reference to the accompanying drawings which are given merely by way of non-limiting example, and in which.

DETAILED DESCRIPTION OF PARTICULAR EMBODIMENTS

Figure 1:
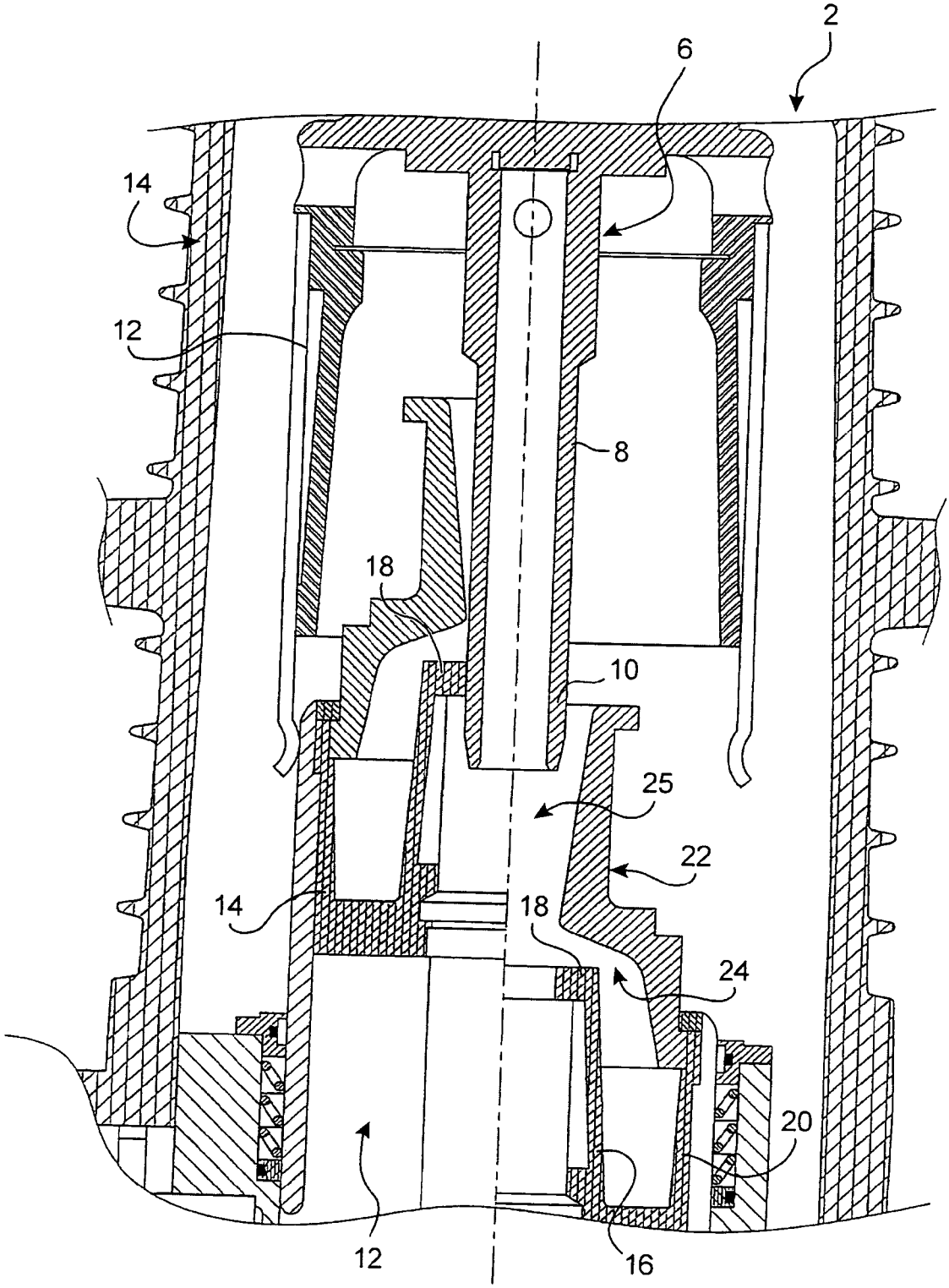
FIG. 1 is a longitudinal section view showing an interrupting chamber that is part of medium-voltage or high-voltage electrical switchgear of the invention.

FIG. 1 shows an interrupting chamber 2 that is part of medium-voltage or high-voltage switchgear (not shown) which is, for example, a circuit-breaker. The interrupting chamber is arranged conventionally and, therefore, it is described only briefly below.

The chamber 2, which is delimited by an insulating cylindrical casing 4, is filled with an insulating gas that is different from $CF_4$ and from $SF_6$. For example, the insulating gas is nitrogen, nitrogen oxide, argon, carbon dioxide, or mixtures thereof. The chamber contains firstly a fixed contact member given overall reference 6. In conventional manner, said member 6 comprises a support 8 on which an arcing contact element 10 is mounted.

For example, the support 8 is secured to the contact element 10 by any mechanical means, such as screw-fastening or pin-fastening, or by any welding or brazing means. The contact member 6, which is electrically connected to an electrical connector (not shown), is also provided with a permanent current contact 12.

The interrupting chamber 2 also encloses a moving contact member given overall reference 14. Said moving contact member comprises a support 16 on which a moving contact element 18 is mounted.

The support 16 is secured to the contact element 18 analogously to the above-mentioned securing between the support 8 and the element 10.

The moving member 14, which is also connected to another electrical connector (not shown) is equipped with a permanent current contact 20. Said permanent current contact supports an insulating nozzle 22 defining an annular channel 24.

Conventionally, when in service, the moving member 14 can be moved between a contact position (shown on the left side of FIG. 1), in which the elements 10 and 18 are in contact with each other, and an interrupting position (shown on the right side of FIG. 1), in which the two elements 10 and 18 are separated from each other.

When the moving member 14 moves from its contact position to its interrupting position, an electric arc strikes between the two contact elements 10 and 18, while an insulating gas is directed, via the annular channel 24, into the zone 25 of said electric arc.

Figure 2:
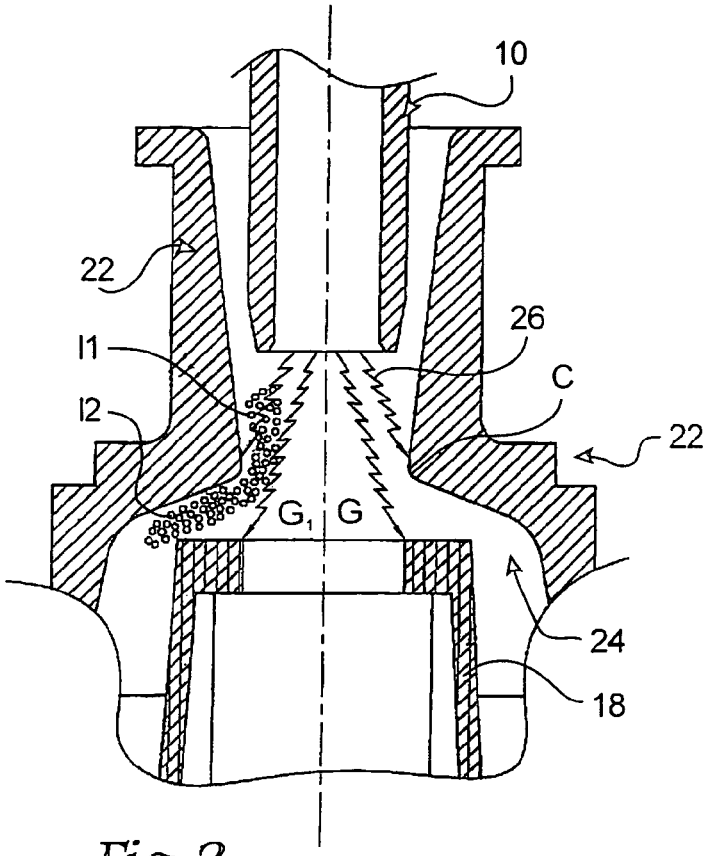
FIG. 2 is a diagrammatic view showing, more precisely, the decomposition of certain elements of the interrupting chamber of FIG. 1 when an electric arc strikes.

FIG. 2 is a diagrammatic view on a larger scale, showing only the arcing contacts 10 and 18 and the insulating nozzle 22. Reference 26 designates the electric arc that strikes between the contacts 10 and 18 when they separate. This arc 26 also propagates along the walls facing the nozzle 22, through the insulating gas which is referenced G.

In this example, the nozzle 22 is made of two materials, namely polytetrafluoroethylene (PTFE), i.e. $(CF_2)$, and an oxide, for example silica $SiO_2$. The percentages by weight of these two component materials are, for example, 65% of PTFE and 35% of $SiO_2$.

In the example shown, the nozzle 22 is made entirely of the two above-mentioned component materials. However, it should be noted that, by way of a variant, said two component materials need be present only on that surface of the nozzle which is to be irradiated by the arc 26 when in service. In which case, the two component materials are advantageously present over a minimum thickness of at least 1 mm. By way of an additional variant, the two above-mentioned component materials can be present only at the neck C of the nozzle, as shown more particularly in FIG. 2.

When the arc 26 irradiates the surfaces facing the nozzle 22, it causes the PTFE and the $SiO_2$ to decompose. The resulting decomposed species, present in a plasma, are shown diagrammatically in FIG. 2, and they are given references $e_1$ and $e_2$.

For example, in this example, the ionic species $C^+$ and $F^-$ are to be found in the plasma. Then, in the plasma, the decomposed species $e_1$ and $e_2$ recombine, in a substantially immediate reaction so as to form a new gaseous species which is referenced $G_1$ in FIG. 2. In the present example, two new gas are produced, carbon tetrafluoride $CF_4$ and carbon dioxide $CO_2$, and solid silicon being formed during the formation of the gas.

The various physico-chemical phenomena mentioned above are illustrated by the following equation [1], which, it should be emphasized, merely shows a principle.

$$(CF_2)_n+SiO_2+\text{energy}\rightarrow C+F+Si+O\rightarrow CF_4+CO_2+Si \quad [1]$$

It should be emphasized that, by means of the presence of the oxide, the oxygen initially belonging to it combines with the carbon decomposed from the PTFE to form carbon dioxide. This thus makes it possible to prevent pure carbon from being produced, which would tend to be deposited on the walls of the nozzle, and would thus degrade the performance of the switchgear, in particular in dielectric terms.

In the above example, a solid fluoride and an oxide are associated in the nozzle 22. By way of a variant, it is possible to associate a fluoride, such as PTFE, with a solid sulfide, for example molybdenum sulfide ($MoS_2$), with an oxide, for example silica. The proportions by weight in the nozzle are then evaluated so that the mass ratio of oxide on solid sulfide lies between 2 and 3, whereas this oxide and this solid sulfide represent, by volume, between 25 and 40%, preferably between 30 and 35%, of the total formed by the fluorine-containing polymer, the solid sulfide and the oxide.

The various phenomena described above can be expressed by the following equation [2]:

$$(CF_2)_n+MoS_2+SiO_2+\text{energy}\rightarrow Mo+Si+C+O+S+F\rightarrow Mo+Si+CO_2+SF_6 \quad [2]$$

When the arc strikes, it causes the fluoride, the sulfide and the oxide to decompose. Then the resulting decomposed species recombine so as to form, in particular, a new gaseous species, namely sulfur hexafluoride $SF_6$.

By way of a variant, it is possible to replace the molybdenum sulfide ($MoS_2$) with antimony sulfide ($Sb_2S_5$). The proportions by weight in the nozzle are then evaluated so that the mass ratio of oxide on solid sulfide lies between 2 and 3, whereas this oxide and this solid sulfide represent, by volume, between 25 and 40%, preferably between 30 and 35%, of the total formed by the fluorine-containing polymer, the solid sulfide and the oxide.

$$Sb_2S_5+(CF_2)_n+SiO_2+\text{energy}\rightarrow Sb+Si+C+O+S+F\rightarrow Sb+Si+CO_2+SF_6 \quad [3]$$

Equation [4] below illustrates an additional variant embodiment, in which, in addition to PTFE and $SiO_2$ as in equation [1], the nozzle 22 includes a solid nitride which, in this example, is boron nitride BN.

$$(CF_2)_n+BN+SiO_2+\text{energy}\rightarrow C+F+B+N+Si+O\rightarrow CF_4+N_2O+CO_2+Si+B \quad [4]$$

When an arc strikes, these various component materials decompose and then recombine, so as to form three different gases, whose dielectric properties are better than those of the initial interrupting gas. In this example, the three gases are carbon hexafluoride ($CF_4$), nitrous oxide ($N_2O$), and carbon dioxide ($CO_2$).

In the various examples above, illustrated by the equations [1] to [4], the nozzle 22 comprises two or three component materials suitable for decomposing under the action of the electric arc, so as to form at least one new gaseous species, whose dielectric properties are better than those of the initial interrupting gas, such as nitrogen.

By way of a variant, the above-mentioned component materials, of which there are at least two, can be part of solid elements of the electrical switchgear that are different from the nozzle 22. Thus, said component materials can be included in one or other of the arcing contacts 10 or 18.

Figure 3:
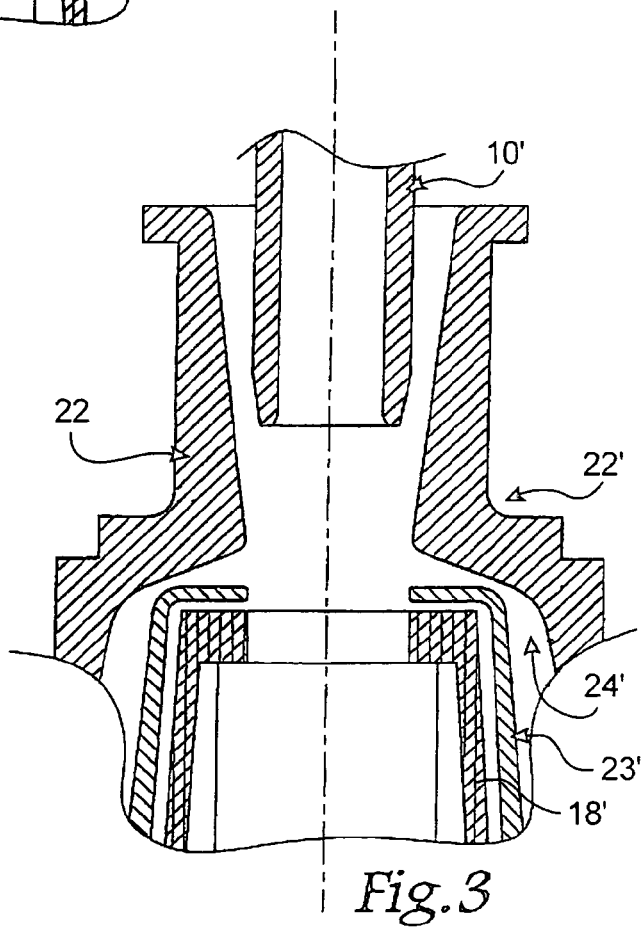
FIG. 3 is a diagrammatic view analogous to FIG. 2, showing a variant embodiment of the invention.

Another possibility is also illustrated by FIG. 3, in which the mechanical elements analogous to those in FIG. 2 are designated by like numerals, with the "prime" sign added. There is an additional intermediate part 23 that is substantially cylindrical, and that is specifically dedicated to the function of delivering a decomposed species under the action of the electric arc.

Using the various examples of equations [1] to [4], said part 23 can be made at least in part of fluoride, such as $(CF_2)_n$ or of a different fluoride such as $CaF_2$, or of a sulfide, such as $MoS_2$ or indeed $Sb_2S_5$. For example, said part 23 can be made of two different fluorides. In this case, a new gas will be made, carbon tetrafluoride ($CF_4$), with formation of solid calcium as in the following equation [5], which has only a character of principle.

$$(CF_2)_n+CaF_2+\text{energy}\rightarrow C+F+Ca\rightarrow Ca+CF_4 \quad [5]$$

For example, if the nozzle is made of PTFE and oxide, the part 23 can be made of two different fluorides, as $(CF_2)_n$ and $CaF_2$, with mass ratio of 65% of PTFE and 35% of $CaF_2$. Moreover, this part 23 can also include an oxide.

In the above, the various component materials that are suitable for decomposing under the action of the arc, including the oxides serving to prevent pure carbon from being formed, are part of solid elements of the interrupting chamber. By way of an additional variant, it is possible to make provision for at least one such component material to be initially in gaseous form.

In which case, the or each gaseous component material that is suitable for decomposing under the effect of the electric arc is formed by one or more additional gases associated with the proper interrupting gas.

Thus, xenon fluoride $X_eF_4$ can be associated with the interrupting gas, which is, for example, nitrogen. For example, in the range 1% by volume to 20% by volume of $XeF_4$ is then to be found. It is also assumed that the nozzle 22 is made of PTFE filled with oxide.

Under these conditions, when the electric arc strikes, decomposition takes place in which both the additional gas, the PTFE and the oxide decompose. The resulting decomposed species then recombine substantially immediately, so as to form $CF_4$ and xenon Xe. Provision can be made to trap the resulting pure xenon, e.g. by means of molecular sieves.

The various phenomena mentioned above are illustrated by the following equation [6]:

$$XeF_4+(CF_2)_n+SiO_2+\text{energy}\rightarrow Xe+C+F+Si+O\rightarrow Xe+CF_4+Si+CO_2 \quad [6]$$

It is also possible to consider associating xenon fluoride both with a solid fluoride and with a solid sulfide, such as PTFE and $MoS_2$. The latter two component materials are then included either in the same solid element such as the nozzle 22, or in two distinct solid elements, such as the nozzle 22' and the part 23' of FIG. 3. The phenomena involved when the electric arc strikes are illustrated by the following equation [7]:

$$XeF_4+(CF_2)_n+MOS_2+SiO_2+\text{energy}\rightarrow Xe+Mo+C+S+F+Si+O\rightarrow Xe+Mo+CF_4+SF_6+Si+CO_2 \quad [7]$$

It should be noted that, in the example of equation [7], associating xenon fluoride with a solid fluoride and with a solid sulfide causes both $CF_4$ and $SF_6$ to be formed.

By way of a variant, it should be noted that it is possible to use other types of gaseous fluorides, such as $XeF_2$, $SiF_4$, or $NF_3$. Indeed, the interrupting gas can be associated with an additional fluorinated gas, preferably selected from $XeF_4$, $XeF_2$, $SiF_4$ or $NF_3$, and the fluorinated gas can be, for example, in proportions of 1 to 20% by volume.

Equations [8], [9] and [10] below illustrate three additional variant embodiments of the invention.

In an example, the nozzle can be made of PTFE and oxide, for example silica, and the part 23 can be made of PTFE and solid nitride, and a gas is enclosed inside the electrical switchgear. Equation [8] illustrates the reaction of PTFE associated with a gas, which is sulfur dioxide $SO_2$ in this example, and with a solid nitride, which is boron nitride BN in this example. In this example, when the arc strikes, these various species decompose and then recombine so as to form the same three gases as in the above equation [4].

$$(CF_2)_n+SO_2+BN+\text{energy}\rightarrow C+F+S+O+B+N\rightarrow CF_4+N_2O+CO_2+B+S \quad [8]$$

Equations [9 and [10] involve reactions of decomposition and then of combination, which are entirely gaseous. Xenon fluoride $XeF_4$ is associated in them either with sulfur dioxide $SO_2$ or with carbon dioxide $CO_2$.

$$SO_2+XeF_4+\text{energy}\rightarrow S+O+Xe+F\rightarrow SF_6+Xe+O \quad [9]$$

$$CO_2+XeF_4+\text{energy}\rightarrow C+O+Xe+F\rightarrow CF_4+Xe+O \quad [10]$$

It should be noted that the invention is applicable to any type of medium-voltage or high-voltage switchgear, in particular regardless of the geometrical shape of said switchgear, namely regardless of whether or not it is circularly symmetrical. The interrupting of such switchgear can take place by various relative movements of the contact members, be they in translation or in rotation.

It should also be emphasized that the invention is advantageous for economic reasons. Indeed, the component materials suitable for decomposing under the action of the electric arc can be chosen such that their costs are relatively low. In addition, such component materials are readily available in industry, in large quantities.

The invention clamed is:

1. Medium-voltage or high-voltage electrical switchgear, the electrical switchgear being a circuit-breaker or a disconnector, comprising an interrupting chamber enclosing an interrupting gas substantially devoid of sulfur hexafluoride ($SF_6$) and of carbon tetrafluoride ($CF_4$), the interrupting chamber containing a first contact member and a second contact member, which contact members are provided respectively with a first arcing contact and with a second arcing contact, the two arcing contacts being suitable, when in service, for taking up a first position in which they are in contact with each other, and a second position in which they are separated from each other, the two arcing contacts moving between the first position and the second position causing an electric arc to strike, while at least one irradiation wall suitable for being reached by the electric arc is provided in the vicinity of said arcing contacts;

at least two component materials including at least one element selected from the interrupting gas, the first arcing contact and the second arcing contact, and said at least one irradiation wall, being suitable for decomposing under the effect of the electric arc to form decomposed species suitable for combining in the interrupting chamber to form at least one new gaseous species, at least while the electric arc is being extinguished, the dielectric properties of said at least one new gaseous species being superior to the dielectric properties of said interrupting gas;

at least one element selected from the interrupting gas, the first arcing contact and the second arcing contact, and the at least one irradiation wall includes an oxide suitable for decomposing under the effect of the electric arc, so as to form at least one auxiliary decomposed species suitable for combining with the decomposed species, so as to prevent pure carbon from forming, said oxide being associated with at least one solid fluoride, in the same solid element, said electrical switchgear being characterized in that the solid fluoride is a fluorine-containing polymer, the proportion by weight of the fluorine-containing polymer being in the range 50% to 80%, and preferably in the range 60% to 70%, of the total formed by the fluorine-containing polymer and by said oxide.

2. Switchgear according to claim 1, characterized in that the interrupting gas includes at least one additional gas, which contains at least one gaseous component suitable for decomposing the at least one additional gas being a fluorine-containing gas, and/or a carbon-containing gas, and/or a sulfur-containing gas.

3. Switchgear according to claim 2, characterized in that the fluorine-containing gas is selected from $XeF_4$, $XeF_2$, $SiF_4$ or $NF_3$.

4. Switchgear according to claim 3, characterized in that fluorine-containing gas lies in the range 1 to 20% by volume.

5. Switchgear according to claim 1, characterized in that the interrupting gas includes at least one additional gas, which contains at least one gaseous component suitable for decomposing, the at least one additional gas being a fluorine-containing gas, including carbon tetrafluoride ($CF_4$) and/or sulfur hexafluoride ($SF_6$), $CF_4$ and/or $SF_6$ being present in very small quantities, at the most equal to a few percent.

6. Switchgear according to claim 1, characterized in that the at least one new gaseous species contains fluorine and sulfur and/or carbon.

7. Switchgear according to claim 6, characterized in that the at least one new gaseous species is/are carbon tetrafluoride ($CF_4$) and/or sulfur hexafluoride ($SF_6$).

8. Switchgear according to claim 1, characterized in that the at least one new gaseous species contains oxygen and carbon and/or nitrogen.

9. Switchgear according to claim 8, characterized in that the at least one new gaseous species is/are carbon dioxide ($CO_2$) and/or nitrous oxide ($N_2O$).

10. Switchgear according to claim 1, characterized in that at least one component material suitable for decomposing under the effect of the electric arc is part of at least one solid element, the at least one component material being present at least on the surface of said solid element which is irradiated by the electric arc, when in service.

11. Switchgear according to claim 10, characterized in that one solid element is constituted by an insulating nozzle for channeling the interrupting gas.

12. Switchgear according to claim 11, characterized in that at least one component material that is suitable for decomposing is part of said insulating nozzle, while at least one other component material that is suitable for decomposing is part of another irradiation wall, distinct from said nozzle.

13. Switchgear according to claim 10, characterized in that at least one component material that is part of at least one solid element and that is different from the element comprising the oxide associated to the at least one solid fluoride, is a solid fluoride.

14. Switchgear according to claim 13, characterized in that a first component material that is suitable for decomposing is a fluorine-containing polymer while another component suitable for decomposing is another fluoride, of a different type.

15. Switchgear according to claim 14, characterized in that the fluorine-containing polymer and the other type of fluoride are part of the same solid element and in that the proportion by weight of the fluorine-containing polymer lies in the range 60% to 80%, and preferably in the range 65% to 75%, of the total constituted by the fluorine-containing polymer and by the other solid fluoride.

16. Switchgear according to claim 10, characterized in that at least one component material that is part of at least one solid element is a solid sulfide.

17. Switchgear according to claim 13, characterized in that at least one component material that is suitable for decomposing is a solid fluoride, while at least one other component material that is suitable for decomposing is a solid sulfide.

18. Switchgear according to claim 17, characterized in that a first component material is a fluorine-containing polymer while another component is a solid sulfide.

19. Switchgear according to claim 18, characterized in that the fluorine-containing polymer and the solid sulfide are part of the same solid element and in that the proportion by weight of the fluorine-containing polymer lies in the range 50% to 80%, and preferably in the range 60% to 70%, of the total constituted by the fluorine-containing polymer and by the solid sulfide.

20. Switchgear according to claim 17, characterized in that a first component material is a fluorine-containing polymer, a second component material is another type of solid fluoride, while a third component material is a solid sulfide.

21. Switchgear according to claim 20, characterized in that the fluorine-containing polymer, the other fluoride and the sulfide are part of the same solid element and in that the ratio by weight of the other fluoride to the sulfide lies in the range 3 to 4, while said other fluoride and the sulfide represent, by volume, 25% to 40%, and preferably 30% to 35%, of the total formed by the fluorine-containing polymer, by the other fluoride, and by the sulfide.

22. Switchgear according to claim 1, characterized in that at least one component material that is suitable for decomposing under the effect of the electric arc is a gaseous component.

23. Switchgear according to claim 1, characterized in that the solid fluoride includes polytetrafluoroethylene (PTFE).

24. Switchgear according to claim 2, characterized in that the at least one additional gas is selected from xenon fluoride ($XeF_4$), carbon dioxide ($CO_2$) and sulfur dioxide ($SO_2$).

25. Switchgear according to claim 14, characterized in that the fluorine-containing polymer includes polytetrafluoroethylene (PTFE).

26. Switchgear according to claim 18, characterized in that the fluorine-containing polymer includes polytetrafluoroethylene (PTFE).

27. Switchgear according to claim 20, characterized in that the fluorine-containing polymer includes polytetrafluoroethylene (PTFE).

28. Medium-voltage or high-voltage electrical switchgear, the electrical switchgear being a circuit-breaker or a disconnector, comprising an interrupting chamber enclosing an interrupting gas substantially devoid of sulfur hexafluoride ($SF_6$) and of carbon tetrafluoride ($CF_4$), the interrupting chamber containing a first contact member and a second contact member, which contact members are provided respectively with a first arcing contact and with a second arcing contact, the two arcing contacts being suitable, when in service, for taking up a first position in which they are in contact with each other, and a second position in which they are separated from each other, the two arcing contacts moving between the first position and the second position causing an electric arc to strike, while at least one irradiation wall suitable for being reached by the electric arc is provided in the vicinity of said arcing contacts;

at least two component materials including at least one element selected from the interrupting gas, the first arcing contact and the second arcing contact, and the at least one irradiation wall, being suitable for decomposing under the effect of the electric arc, so as to form decomposed species suitable for combining in the interrupting chamber, in order to form at least one new gaseous species, at least while the electric arc is being extinguished, the dielectric properties of said at least one new gaseous species being superior to the dielectric properties of said interrupting gas;

at least one element selected from the interrupting gas, the first arcing contact and the second arcing contact, and the at least one irradiation wall includes an oxide suitable for decomposing under the effect of the electric arc, so as to form at least one auxiliary decomposed species suitable for combining with the decomposed species, so as to prevent pure carbon from forming, said oxide being associated with at least one solid fluoride, in the same solid element;

said electrical switchgear being characterized in that said oxide is also associated, in the same solid element, with a fluorine-containing polymer, and with a solid sulfide and in that the ratio by weight of the oxide to the solid sulfide lies in the range 2 to 3, while said oxide and said solid sulfide represent, by volume, 25% to 40%, and preferably 30% to 35%, of the total formed by the fluorine-containing polymer, by the solid sulfide, and by the oxide.

29. Switchgear according to claim 28, characterized in that the interrupting gas includes at least one additional gas, which contains at least one gaseous component suitable for decomposing, the at least one additional gas being a fluorine-containing gas, and/or a carbon-containing gas and/or a sulfur-containing gas.

30. Switchgear according to claim 29, characterized in that the additional gas is the fluorine-containing gas is selected from $XeF_4$, $XeF_2$, $SiF_4$ or $NF_3$.

31. Switchgear according to claim 30, characterized in that the fluorine-containing gas lies in the range 1 to 20% by volume.

32. Switchgear according to claim 28, characterized in that the interrupting gas includes at least one additional gas, which contains at least one gaseous component suitable for decomposing, the at least one additional gas being a fluorine-containing gas, including carbon tetrafluoride ($CF_4$) and/or sulfur hexafluoride ($SF_6$), $CF_4$ and/or $SF_6$ being present in very small quantities, at the most equal to a few percent.

33. Switchgear according to claim 28, characterized in that the at least one new gaseous species contains fluorine and sulfur and/or carbon.

34. Switchgear according to claim 33, characterized in that the at least one new gaseous species is/are carbon tetrafluoride ($CF_4$) and/or sulfur hexafluoride ($SF_6$).

35. Switchgear according to claim 28, characterized in that the at least one new gaseous species contains oxygen and carbon and/or nitrogen.

36. Switchgear according to claim 35, characterized in that the at least one new gaseous species is/are carbon dioxide ($CO_2$) and/or nitrous oxide ($N_2O$).

37. Switchgear according to claim 28, characterized in that at least one component material suitable for decomposing under the effect of the electric arc is part of at least one solid element, the at least one component material being present at least on the surface of said solid element which is irradiated by the electric arc, when in service.

38. Switchgear according to claim 37, characterized in that one solid element is constituted by an insulating nozzle for channeling the interrupting gas.

39. Switchgear according to claim 38, characterized in that at least one component material that is suitable for decomposing is part of said insulating nozzle, while at least one other component material that is suitable for decomposing is part of another irradiation wall, distinct from said nozzle.

40. Switchgear according to claim 37, characterized in that at least one component material that is part of at least one solid element and that is different from the element comprising the oxide associated to the at least one solid fluoride, is a solid fluoride.

41. Switchgear according to claim 40, characterized in that a first component material that is suitable for decomposing is a fluorine-containing polymer, including polytetrafluoroethylene (PTFE), while another component suitable for decomposing is another fluoride, of a different type.

42. Switchgear according to claim 41, characterized in that the fluorine-containing polymer and the other type of fluoride are part of the same solid element and in that the proportion by weight of the PTFE lies in the range 60% to 80%, and preferably in the range 65% to 75%, of the total constituted by the fluorine-containing polymer and by the other solid fluoride.

43. Switchgear according to claim 37, characterized in that at least one component material that is part of at least one solid element is a solid sulfide.

44. Switchgear according to claim 40, characterized in that at least one component material that is suitable for decomposing is a solid fluoride, while at least one other component material that is suitable for decomposing is a solid sulfide.

45. Switchgear according to claim 44, characterized in that a first component material is a fluorine-containing polymer, while another component is a solid sulfide.

46. Switchgear according to claim 45, characterized in that the fluorine-containing polymer and the solid sulfide are part of the same solid element and in that the proportion by weight of the fluorine-containing polymer lies in the range 50% to 80%, and preferably in the range 60% to 70%, of the total constituted by the fluorine-containing polymer and by the solid sulfide.

47. Switchgear according to claim 44, characterized in that a first component material is a fluorine-containing polymer, a second component material is another type of solid fluoride, while a third component material is a solid sulfide.

48. Switchgear according to claim 37, characterized in that the fluorine-containing polymer, the other fluoride and the sulfide are part of the same solid element and in that the ratio by weight of the other fluoride to the sulfide lies in the range 3 to 4, while said other fluoride and the sulfide represent, by volume, 25% to 40%, and preferably 30% to 35%, of the total formed by the fluorine-containing polymer, by the other fluoride, and by the sulfide.

49. Switchgear according to claim 28, characterized in that at least one component material that is suitable for decomposing under the effect of the electric arc is a gaseous component.

50. Switchgear according to claim 28, characterized in that the fluorine-containing polymer includes polytetrafluoroethylene (PTFE).

51. Switchgear according to claim 29, characterized in that the at least one additional gas is selected from xenon fluoride ($XeF_4$), carbon dioxide ($CO_2$) and sulfur dioxide ($SO_2$).

52. Switchgear according to claim 45, characterized in that the fluorine-containing polymer includes polytetrafluoroethylene (PTFE).

53. Switchgear according to claim 47, characterized in that the fluorine-containing polymer includes polytetrafluoroethylene (PTFE).

54. Medium-voltage or high-voltage electrical switchgear, the electrical switchgear being a circuit-breaker or a disconnector, comprising an interrupting chamber enclosing an interrupting gas substantially devoid of sulfur hexafluoride ($SF_6$) and of carbon tetrafluoride ($CF_4$), the interrupting chamber containing a first contact member and a second contact member, which contact members are provided respectively with a first arcing contact and with a second arcing contact, the two arcing contacts being suitable, when in service, for taking up a first position in which they are in contact with each other, and a second position in which they are separated from each other, the two arcing contacts moving between the first position and the second position causing an electric arc to strike, while at least one irradiation wall suitable for being reached by the electric arc is provided in the vicinity of said arcing contacts;

at least two component materials including at least one element selected from the interrupting gas, the first arcing contact and the second arcing contact, and the at least one irradiation wall, being suitable for decomposing under the effect of the electric arc to form decomposed species suitable for combining in the interrupting chamber to form at least one new gaseous species, at least while the electric arc is being extinguished, the dielectric properties of said at least one new gaseous species being superior to the dielectric properties of said interrupting gas;

at least one element selected from the interrupting gas, the first arcing contact and the second arcing contact, and the at least one irradiation wall includes an oxide suitable for decomposing under the effect of the electric arc, so as to form at least one auxiliary decomposed species suitable for combining with the decomposed species, so as to prevent pure carbon from forming, said oxide being associated with at least one solid fluoride, in the same solid element, said electrical switchgear being characterized in that said oxide is also associated, in the same solid element, with a fluorine-containing polymer, and with a solid nitride.

55. Switchgear according to claim 54, characterized in that the ratio by weight of the oxide to the solid nitride lies in the range 0.4 to 3, and in that said oxide and said solid nitride represent, by weight, 25% to 40%, and preferably 30% to 35%, of the total formed by the fluorine-containing polymer, by the oxide and by the solid nitride.

56. Switchgear according to claim 54, characterized in that the interrupting gas includes at least one additional gas, which contains at least one gaseous component suitable for decomposing, the at least one additional gas being a fluorine-containing gas and/or a carbon-containing gas and/or a sulfur-containing gas.

57. Switchgear according to claim 56, characterized in that the additional gas is the fluorine-containing gas is selected from $XeF_4$, $XeF_2$, $SiF_4$ or $NF_3$.

58. Switchgear according to claim 57, characterized in that the fluorine-containing gas lies in the range 1 to 20% by volume.

59. Switchgear according to claim 54, characterized in that the interrupting gas includes at least one additional gas, which contains at least one gaseous component suitable for decomposing, the at least one additional gas being a fluorine-containing gas, including carbon tetrafluoride ($CF_4$) and/or sulfur hexafluoride ($SF_6$), $CF_4$ and/or $SF_6$ being present in very small quantities, at the most equal to a few percent.

60. Switchgear according to claim 54, characterized in that the at least one new gaseous species contains fluorine and sulfur and/or carbon.

61. Switchgear according to claim 60, characterized in that the at least one new gaseous species is/are carbon tetrafluoride ($CF_4$) and/or sulfur hexafluoride ($SF_6$).

62. Switchgear according to claim 54, characterized in that the at least one new gaseous species contains oxygen and carbon and/or nitrogen.

63. Switchgear according to claim 54, characterized in that the at least one new gaseous species is/are carbon dioxide ($CO_2$) and/or nitrous oxide ($N_2O$).

64. Switchgear according to claim 54, characterized in that at least one component material suitable for decomposing under the effect of the electric arc is part of at least one solid element, the at least one component material being present at least on the surface of said solid element which is irradiated by the electric arc, when in service.

65. Switchgear according to claim 64, characterized in that one solid element is constituted by an insulating nozzle for channeling the interrupting gas.

66. Switchgear according to claim 64, characterized in that at least one component material that is suitable for decomposing is part of said insulating nozzle, while at least one other component material that is suitable for decomposing is part of another irradiation wall, distinct from said nozzle.

67. Switchgear according to claim 64, characterized in that at least one component material that is part of at least one solid element and that is different from the element comprising the oxide associated to the at least one solid fluoride, is a solid fluoride.

68. Switchgear according to claim 67, characterized in that a first component material that is suitable for decomposing is a fluorine-containing polymer, including polytetrafluoroethylene (PTFE), while another component suitable for decomposing is another fluoride, of a different type.

69. Switchgear according to claim 68, characterized in that the fluorine-containing polymer and the other type of fluoride are part of the same solid element and in that the proportion by weight of the PTFE lies in the range 60% to 80%, and preferably in the range 65% to 75%, of the total constituted by the fluorine-containing polymer and by the other solid fluoride.

70. Switchgear according to claim 64, characterized in that at least one component material that is part of at least one solid element is a solid sulfide.

71. Switchgear according to claim 67, characterized in that at least one component material that is suitable for decomposing is a solid fluoride, while at least one other component material that is suitable for decomposing is a solid sulfide.

72. Switchgear according to claim 71, characterized in that a first component material is a fluorine-containing polymer, while another component is a solid sulfide.

73. Switchgear according to claim 72, characterized in that the fluorine-containing polymer and the solid sulfide are part of the same solid element and in that the proportion by weight of the fluorine-containing polymer lies in the range 50% to 80%, and preferably in the range 60% to 70%, of the total constituted by the fluorine-containing polymer and by the solid sulfide.

74. Switchgear according to claim 71, characterized in that a first component material is a fluorine-containing polymer, a second component material is another type of solid fluoride, while a third component material is a solid sulfide.

75. Switchgear according to claim 74, characterized in that the fluorine-containing polymer, the other fluoride and the sulfide are part of the same solid element and in that the ratio by weight of the other fluoride to the sulfide lies in the range 3 to 4, while said other fluoride and the sulfide represent, by volume, 25% to 40%, and preferably 30% to 35%, of the total formed by the fluorine-containing polymer, by the other fluoride, and by the sulfide.

76. Switchgear according to claim 74, characterized in that at least one component material that is suitable for decomposing under the effect of the electric arc is a gaseous component.

77. Switchgear according to claim 54, characterized in that the fluorine-containing polymer includes polytetrafluoroethylene (PTFE).

78. Switchgear according to claim 56, characterized in that the at least one additional gas is selected from xenon fluoride ($XeF_4$), carbon dioxide ($CO_2$) and sulfur dioxide ($SO_2$).

79. Switchgear according to claim 72, characterized in that the fluorine-containing polymer includes polytetrafluoroethylene (PTFE).

80. Switchgear according to claim 74, characterized in that the fluorine-containing polymer includes polytetrafluoroethylene (PTFE).

* * * * *